United States Patent [19]

Manning

[11] 4,424,005

[45] Jan. 3, 1984

[54] METHOD AND APPARATUS FOR CONTROLLING THE CAPACITY OF A RECIPROCATING COMPRESSOR

[75] Inventor: John D. Manning, Liverpool, N.Y.

[73] Assignee: Carrier Corporation, Syracuse, N.Y.

[21] Appl. No.: 314,350

[22] Filed: Oct. 26, 1981

[51] Int. Cl.[3] ..... F04B 49/00; F04B 23/00; F04B 39/10

[52] U.S. Cl. ..... 417/53; 417/440; 417/494

[58] Field of Search ..... 417/274, 275, 283, 284, 417/296, 440, 441, 442, 494, 502, 298, 53; 92/60.5

[56] References Cited

U.S. PATENT DOCUMENTS

| | | | |
|---|---|---|---|
| 302,978 | 8/1884 | Brislin | 417/571 |
| 846,685 | 3/1907 | Mumford | 92/163 |
| 1,602,209 | 3/1925 | Proell | 137/494 |
| 2,090,781 | 8/1937 | Camner | 417/494 |
| 2,626,099 | 1/1953 | Ashley | 230/25 |
| 2,647,683 | 9/1950 | Schweller | 230/21 |
| 2,755,987 | 7/1953 | Gerteis | 230/22 |
| 2,981,198 | 8/1958 | Nettel | 103/41 |
| 3,045,892 | 7/1962 | White | 92/59 |
| 3,119,550 | 1/1964 | West et al. | 230/2 |
| 3,166,236 | 1/1965 | Michener | 417/298 |
| 3,496,873 | 2/1970 | Winter | 417/270 |
| 3,844,686 | 10/1974 | Le Blanc | 417/298 |

*Primary Examiner*—William L. Freeh
*Assistant Examiner*—Paul F. Neils
*Attorney, Agent, or Firm*—Robert P. Hayter

[57] ABSTRACT

An apparatus and a method for controlling the capacity of a reciprocating compressor by altering the effective stroke length of the working piston of the compressor is disclosed. The working piston of the compressor has a piston opening extending through the top surface thereof. A bypass piston having a cylindrical portion sized to block the piston opening and a reduced cross-sectional portion designed to allow gas to flow through the piston opening is provided. By adjusting the position of the bypass piston the effective stroke length of the working piston may be controlled to allow modulating compressor operation.

8 Claims, 2 Drawing Figures

METHOD AND APPARATUS FOR CONTROLLING THE CAPACITY OF A RECIPROCATING COMPRESSOR

BACKGROUND OF THE INVENTION

1. Field of the Invention

The present invention relates to a method and apparatus for controlling the capacity of a reciprocating compressor. More particularly, the present invention concerns a bypass piston acting in conjunction with a compression piston for regulating the amount of gas compressed during a single piston stroke in a reciprocating compressor.

2. Description of the Prior Art

A typical reciprocating compressor, as may be used in air conditioning or refrigeration systems, includes a piston reciprocating within a cylinder for mechanically compressing gaseous refrigerant. Appropriate manifolds and valves are provided to allow gas to be drawn into the cylinder during the down stroke of the piston and to be compressed during the up stroke.

In order to operate a compressor efficiently when the system in which it is installed is operating only at part load it is necessary to find some way of reducing the work supplied by the compressor. A typical part load situation might involve a compressor being installed in an air conditioning system wherein the outdoor ambient temperature is sufficiently low that large amounts of cooling are not needed. In this condition the air conditioning system is oversized and if operating only at one capacity level will cycle on and off.

By providing means for reducing the volume output of the compressor, the compressor may be operated continuously at a reduced gaseous flow rate thereby reducing the cycling of the unit. By operating continuously, energy involved in starting and stopping is saved and the compressor itself should have a longer life if it operates at steady state operation.

In addition to the operation of the compressor which is only a portion of the air conditioning system the system is more efficient if it operates continuously rather than cycling at repeated intervals. An air conditioning system operates by having a high pressure condensing portion and a low pressure evaporating portion. Upon deenergization of the compressor, the pressures of the two portions tend to equalize and hence there is an interval during each startup period of the compressor before operating conditions are achieved. When the compressor is not operated the oil mixed with refrigerant may tend to separate or the refrigerant may tend to collect in unwanted areas. Both of these problems are lessened by the continuous operation of the compressor at a lower volume discharge rate.

Numerous methods are known for allowing gas to be bypassed from the cylinder to the suction or low pressure area as opposed to being discharged to the discharge manifold or high pressure area. These systems include the manipulation of the suction valves to allow compressed gas to be discharged back into the suction manifold, installation of additional valves which may open to bleed high pressure gas back into the suction manifold or the installation of bypass lines from the discharge manifold to the suction manifold to accomplish the same purpose. All the systems are effective in reducing the volume flow output of the compressor. However, most of these arrangements provide for the cylinder to be either unloaded or loaded and there is no capability for modulating the load on that cylinder.

The present invention concerns the use of a bypass piston extending through the cylinder head and through a piston opening in the piston. The bypass piston is sized to have a cylindrical portion equivalent to the diameter of the piston opening to prevent gaseous flow therethrough. The bypass piston additionally has a fluted portion having indentations therein which allow gas to flow through the piston opening when that portion of the bypass piston is arranged relative to the piston opening. By varying the position where the fluted portion of the bypass piston is arranged the effective stroke length of the working piston can be controlled. By controlling the effective stroke length the flow rate or the amount of unloading of the compressor is likewise controlled.

SUMMARY OF THE INVENTION

It is an object of the present invention to provide a method of controlling the capacity output of a reciprocating compressor.

It is a further object of the present invention to incorporate a bypass piston with the working piston of a reciprocating compressor to modulate the volume flow output of the reciprocating compressor.

It is another object of the present invention to provide a safe, economical and reliable means for unloading a compressor cylinder within a reciprocating compressor.

It is another object of the present invention to provide a means for modulating the volume flow output of the specific cylinder of a reciprocating compressor.

These and other objects of the present invention are achieved according to the preferred embodiment by incorporation of a bypass piston in conjunction with a working piston. A variable displacement compressor is disclosed which includes a cylinder defining a fixed volume space, a working piston mounted for reciprocating movement within the cylinder for compressing gas located therein, said piston having a bypass opening extending therethrough, drive means for reciprocating the piston within the cylinder and valve means for allowing the gas to be compressed to enter the cylinder and, after it is compressed, to be discharged from the cylinder. A bypass piston sized to extend through and block the bypass opening to prevent the flow of gas therethrough is additionally included. The bypass piston has a portion of reduced cross-sectional area such that when the reduced portion of the bypass piston is located within the bypass opening gas may flow therethrough. Additionally, positioning means for placing the bypass piston to either block the flow through the bypass opening to allow the flow through the bypass opening are provided.

DESCRIPTION OF THE PREFERRED EMBODIMENT

The invention as described herein will refer to a reciprocating compressor for use with an air conditioning or refrigeration system. Although this compressor is shown in a configuration and described relative to incorporation with a refrigeration circuit within an air conditioning system or a refrigeration system it is to be understood that this method of modulating the output of a compressor is equally applicable to the compression of other gases than those serving as refrigerants. It is further to be understood that although a specific means of controlling the positioning of the bypass piston is disclosed that many types of control systems could be equally applicable. Likewise, the physical mounting of the cylinders with the utilization of a V block type compressor or the horizontal versus vertical location thereof are all matters of choice to the designer and do not effect the scope of the present invention.

Figure 1:
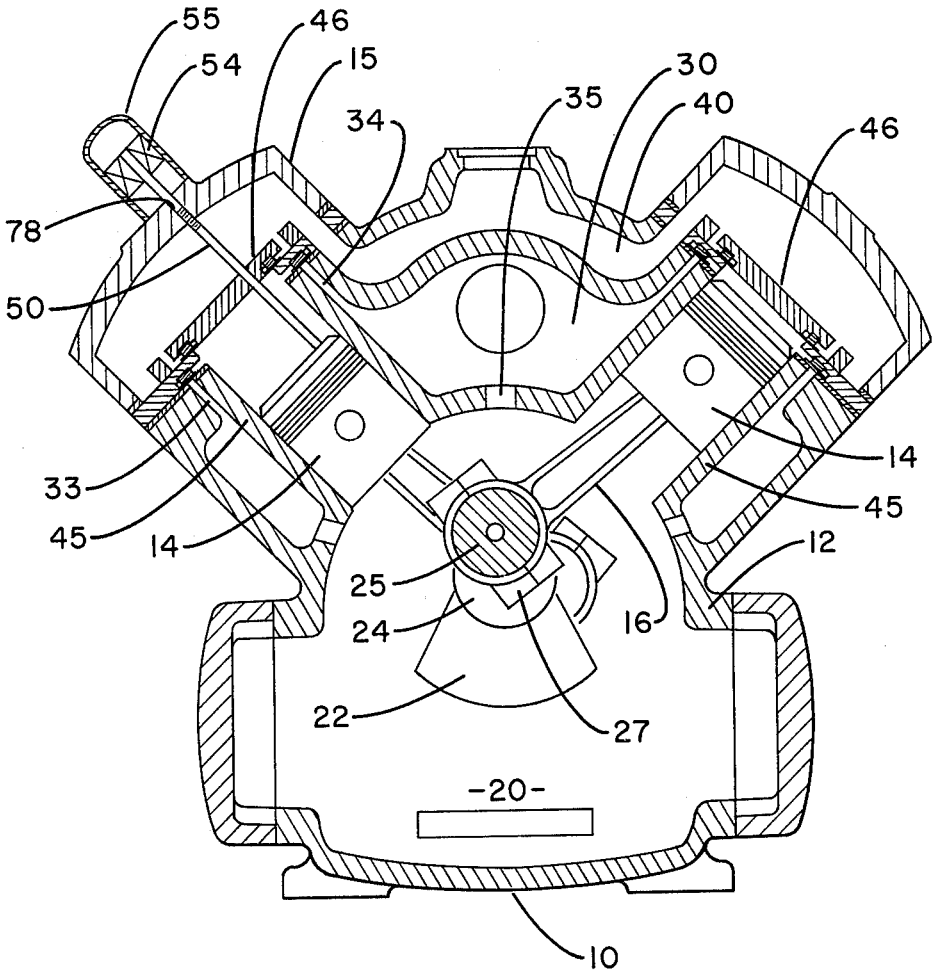
FIG. 1 is a sectional view of a reciprocating type compressor.

Referring now to FIG. 1 there can be seen a compressor 10 including shell 12 and casing 15. Working pistons 14 are mounted for reciprocating movement within cylinders 45. Each piston is connected to crankshaft 24 at portion 25 via a connecting rod 16. Connecting rod 16 is secured around offset portion 25 by fastening bearing cap 27 to the connecting rod to maintain the connecting rod thereto. A bearing may be provided therebetween. Crankshaft 24 includes counterbalance 22 for balancing the rotational irregularities in the crankshaft. The crankshaft is mounted in reservoir 20 capable of maintaining sufficient oil within the compressor to assure that the moving parts are lubricated.

Figure 2:
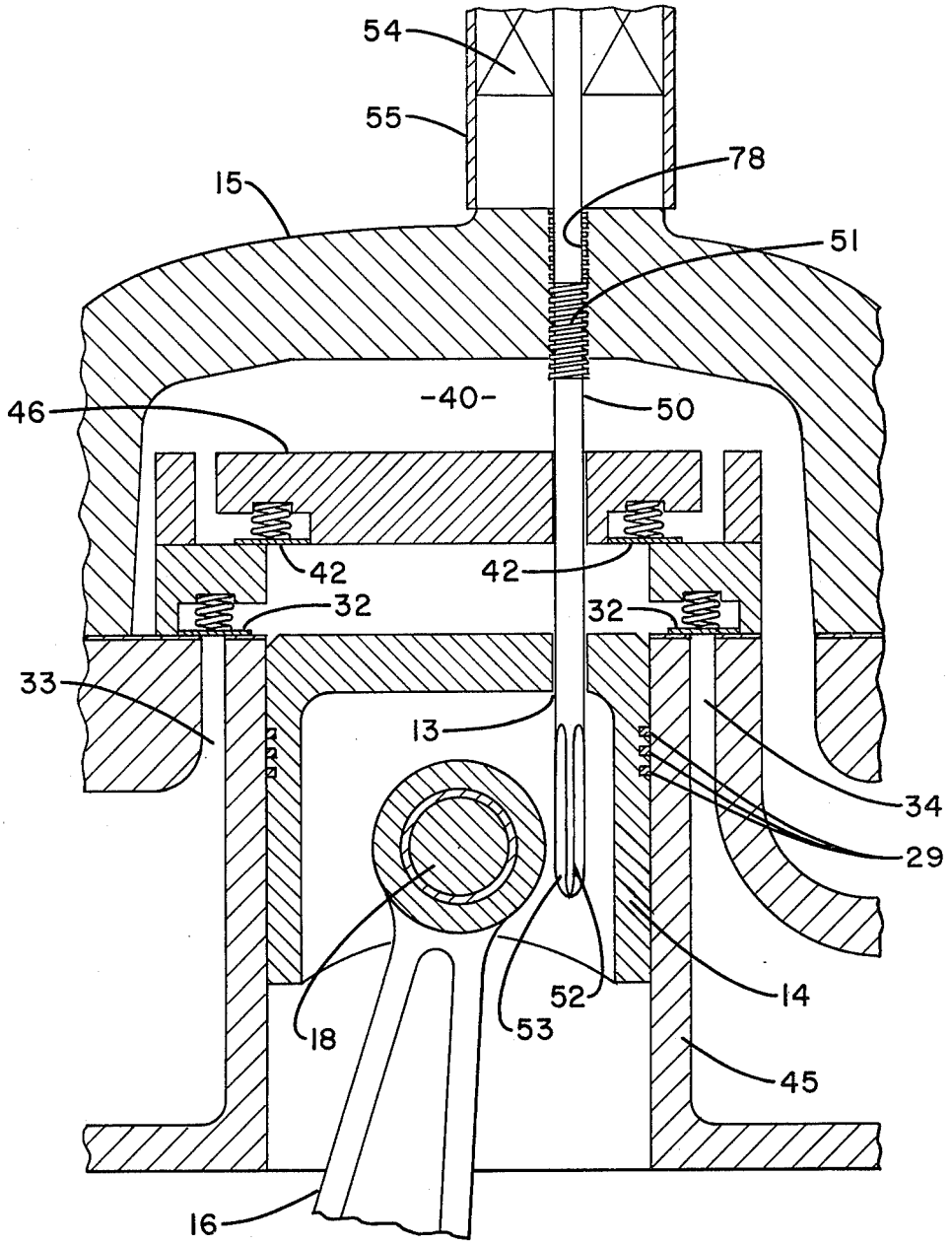
FIG. 2 is an enlarged sectional view of a portion of a reciprocating compressor showing the working piston and the bypass piston.

Suction manifold 30 is shown having opening 35 for connecting reservoir 20 to the suction manifold to maintain the reservoir at suction pressure. It can additionally be seen that a section of manifold 30 is connected by openings 33 and 34 to suction valve 32 shown more particularly in FIG. 2. Openings are provided between the various suction cavities and the reservoir such that each suction line may be supplied from the suction manifold. Cylinder head 46 is located at the top of cylinder 45 and discharge valves 42, as may be seen in FIG. 2, are mounted therein. Discharge manifold 40 extends across the top of the unit and is positioned to receive the high pressure gas discharged upon the upward displacement of one of the working pistons.

In FIGS. 1 and 2 it may be seen that bypass piston 50 extends through casing 15 through threaded opening 58, through cylinder head 46 and through piston opening 13 into the reservoir of the compressor. Bypass piston 50 has a solid, cylindrical portion sized to form a tight fit with piston opening 13 to prevent the flow of gas therethrough and a fluted portion 52 having indentations 53 on the edge thereof such that when the fluted portion is aligned with piston opening 13 gas may flow from the cylinder through the piston opening back to the reservoir maintaining the suction pressure. Piston 50 has a threaded portion engaging threaded opening 78 in casing 15. Stepper motor 54 is shown secured to the exterior of casing 15 and having bypass piston 50 extending therethrough for positioning the bypass piston. Additionally, stepper motor casing 55 is shown secured to the casing with the stepper motor and piston being internal thereof. The stepper motor casing may be a sealed portion helping to prevent the escape of fluids from the compressor.

Referring more specifically to FIG. 2 it can be seen that bypass piston 50 extends through casing 15, cylinder head 46 and piston 14 at piston opening 13. Additionally, the connecting rod 16 is shown connected by wrist pin 18 to working piston 14. Piston rings 29 are shown making a sealing relation between the piston and cylinder 45. Suction lines 33 and 34 are shown connected to supply gas to the cylinder space upon a downward motion of the working piston. Suction valves 32 are secured by springs to block the flow of suction gas into the compressor until sufficient suction pressure is created with the downward stroke of the piston to allow the suction pressure to displace the valve to permit gaseous flow thereinto. Arranged in opposite relationship are discharge valves 42 which, upon sufficient pressure being generated in the cylinder space, open allowing the compressed gas to be discharged into discharge manifold 40.

OPERATION

As the piston reciprocates within the cylinder opening gas is either drawn into the cylinder space or discharged therefrom. Suction valves 32 and discharge valves 42 control the flow of gas either entering or being discharged from the cylinder space. Bypass piston 50, when it is desired to operate the compressor at full capacity, is displaced downwardly such that the piston opening 13 is in contact throughout the entire stroke only with the solid cylindrical portion of the bypass piston preventing gaseous flow therethrough. In this mode, the compressor operates as a normal compressor and as if there were no unloading.

In a fully unloaded state of operation the bypass piston is displaced upwardly such that the fluted portion 52 is located within piston opening 13 throughout the entire stroke of the piston. In this mode, there is little or no pressure differential created between the reservoir and the cylinder space upon the reciprocating motion of the piston. Typically, insufficient suction pressure will be created to allow gas to be drawn into the cylinder space and there will be insufficient compression pressure to displace the discharge valves to allow gas to be discharged to the manifold. Hence, with the fluted portion located within the piston opening the piston will reciprocate, however no work will be done.

To effect partial capacity of the piston the bypass piston is positioned such that the fluted portion is arranged to control the effective stroke length of the working piston. By having the fluted portion extend through the piston opening as the piston starts its stroke but not as the piston finishes its stroke, the working stroke of the piston is limited to that length where the piston opening 13 is sealed by the cylindrical portion of bypass piston 50. Hence, if the cylindrical portion of the bypass piston is located at the midpoint of the working piston stroke, the working piston will effectively act on the volume of gas in half of the cylinder as opposed to the volume of gas of the full stroke length if the full stroke were allowed. Hence, by varying the position of the fluted portion of the bypass piston relative to the working piston it is possible to modulate the capacity over a wide range.

In the embodiment shown in FIG. 1, stepper motor 54 is shown for displacing the bypass piston. Stepper motor 54 rotates piston 50 in both directions to effect upward or downward movement of the piston. The threaded portion 51 of the piston engages threaded opening 78 in the casing to effect movement of the piston as the piston is rotated by the stepper motor. Other methods which might accomplish this function include the utilization of a solenoid and spring arrangement for displacing the piston between selected positions. Other known methods are available for controlling the displacement of a rod type device including a mechanical linkage having various steps.

It is also to be understood that although this bypass piston is disclosed having a fluted portion of reduced cross-sectional area for allowing gas to flow through the piston opening to the reservoir other configurations with reduced cross-sectional areas would be equally effective. The selection of the fluted portion is made such that there are portions of the bypass piston which engage the edges of the piston opening and other portions such as indentations 53 which are removed to allow gas flow therethrough. Hence, with the fluted portion it is possible to maintain the bypass piston in engagement with the edges of the piston opening while allowing gaseous flow therethrough.

While the invention has been described in reference to a preferred embodiment it is to be understood by those skilled in the art that modifications and variations can be effected within the spirit and scope of the invention. It is further to be understood that although the preferred embodiment is described relative to a compressor for air conditioning or refrigeration systems incorporating a refrigeration circuit this compressor has like applicability to the compression of other types of gases.

What is claimed is:

1. A variable displacement compressor which comprises:

a cylinder defining a fixed volume space;

a piston mounted for reciprocating movement within the cylinder for compressing a gas, said piston defining a bypass opening extending therethrough;

means for reciprocating the piston within the cylinder;

valve means for controlling the flow of gas into and out of the cylinder;

a bypass piston sized to extend through and block the bypass opening to prevent the flow of gas therethrough, said bypass piston including a portion of reduced cross-sectional area such that when the reduced portion of the bypass piston is located within the bypass opening gas may flow therethrough; and positioning means for placing the bypass piston to either block flow through the bypass opening or to allow flow through the bypass opening to regulate the capacity of the compressor.

2. The apparatus as set forth in claim 1 wherein the means for reciprocating the piston include a crankshaft and connecting rod, the crankshaft being located in a reservoir in communication with a suction manifold such that gas flowing through the bypass opening is flowing to the suction manifold.

3. The apparatus as set forth in claim 1 wherein the bypass piston is cylindrical in configuration and wherein the portion of reduced cross section is a fluted configuration having indentations which allow gas to flow through the bypass opening.

4. The apparatus as set forth in claim 1 and further including a cylinder head mounted at one end of the cylinder, said cylinder head including a cylinder opening through which the bypass piston extends.

5. The apparatus as set forth in claim 1 wherein the compressor includes an exterior shell and wherein the positioning means is mounted exterior of the shell in engagement with the bypass piston.

6. A method of varying the volume output of a reciprocating compressor which raises the pressure of the gas from a suction pressure to a discharge pressure including a piston reciprocating within a cylinder and valves for allowing gas to pass into and out of the cylinder which comprises the steps of:

allowing gas at suction pressure to enter the cylinder;

displacing the piston to compress the volume of gas in the cylinder to the discharge pressure;

varying the volume of gas being compressed by bypassing a desired portion of the gas in the cylinder through an opening in the piston back to an area maintained at the suction pressure; and controlling the amount of gas flowing through the opening in the piston by including a bypass piston extending through the opening in the piston, said bypass piston having portions of various cross-sectional areas and including positioning the bypass piston relative to the opening in the piston to regulate the flow of gas through the opening.

7. The method as set forth in claim 6 wherein the bypass piston has a cylindrical portion which substantially prevents gas from flowing through the opening and a fluted portion which allows gas to flow through the opening when properly positioned and wherein the step of controlling further comprises positioning the bypass piston relative to the reciprocating piston to have either the cylindrical portion or the fluted portion within the opening.

8. The method as set forth in claim 7 wherein the step of controlling further provides positioning the bypass piston with the fluted portion in the opening in the piston during only a portion of a stroke of the reciprocating piston.

* * * * *